US006119299A

United States Patent [19]

Lin

[11] Patent Number: 6,119,299

[45] **Date of Patent: *Sep. 19, 2000**

[54] APPARATUS FOR CLEANING A CONDUIT

[75] Inventor: Yung-Pin Lin, Taichung, Taiwan

[73] Assignee: Taiwan Semiconductor Manufacturing Company, Ltd, Hsin Chu, Taiwan

[ * ] Notice: This patent is subject to a terminal disclaimer.

[21] Appl. No.: 09/204,779

[22] Filed: Dec. 3, 1998

[51] Int. Cl.[7] ..... F22B 37/48

[52] U.S. Cl. ..... 15/246.5; 15/104.095; 15/104.096; 55/295

[58] Field of Search ..... 134/6, 8, 22.11; 15/104.09, 104.096, 104.11, 236.05, 236.1, 246.5, 249.1, 249.2, 104.068, 104.05, 104.095; 422/210; 55/295

[56] References Cited

U.S. PATENT DOCUMENTS 3,199,575 8/1965 Keller ..... 15/246.5
4,372,761 2/1983 Lindroos ..... 422/210
5,832,843 11/1998 Park et al. ..... 110/214
6,010,576 1/2000 Lin ..... 134/8

*Primary Examiner*—Robert J. Warden, Sr.
*Assistant Examiner*—Kaj K. Olsen
*Attorney, Agent, or Firm*—Tung & Associates

[57] ABSTRACT

An apparatus and a method for cleaning a conduit that has unwanted chemical substances deposited on an interior wall of the conduit are provided. The apparatus utilizes a rack-and-pinion drive mechanism for moving a set of cleaning blades in a rotational motion such that the blades may be driven more reliably and more accurately. The rack-and-pinion drive mechanism further allows the set of cleaning blades to scrape off chemical substances in two directions, i.e., when the pinion gear is rotated either clockwise or counterclockwise. The present invention novel apparatus further provides the alternative of having a second set of blades mounted below the main set of cleaning blades such that a second conduit section situated below the conduit may also be cleaned.

14 Claims, 6 Drawing Sheets

APPARATUS FOR CLEANING A CONDUIT

FIELD OF THE INVENTION

The present invention generally relates to an apparatus and a method for cleaning a conduit that has unwanted chemical substances deposited on an interior wall and more particularly, relates to an apparatus and a method for cleaning a conduit in an exhaust gas reactor that has unwanted chemical substances coated on its interior wall by using a plurality of cleaning knife blades mounted in a tall pinion gear driven by a rack such that the interior wall of the rector may be scraped and unwanted chemical substances may be removed.

BACKGROUND OF THE INVENTION

In the chemical industry, many processes conducted in a plant include the step of treating effluent or exhaust gases from a process machine. The treatment is necessary to either complete a chemical reaction such that unreacted chemicals are not released into the atmosphere, or to convert toxic or flammable components of an exhaust gas into non-toxic or non-flammable components before they are released into the atmosphere. The treatment of effluent gases is particularly important in a semiconductor fabrication plant since most of the process gases utilized are either highly toxic or highly flammable.

A controlled decomposition/oxidation (or CDO) system 10 that is equipped with recirculation and sump pumps is shown as an example in FIG. 1. One of such CDO system is marketed by the Delatech Corp. of Napa, Calif. as part of an exhaust gas conditioning equipment. The system 10 is effective in treating or scrubbing exhaust gases through a thermal reaction section 12 and a cooling/scrubbing section 14. Exhaust gases 18 from a semiconductor process chamber enter into the system through inlet 20 and are first treated in an oxygenation reaction section 22. The oxygenated exhaust gases then enter the thermal reaction section 12 which is heated by heating elements 24. Heating elements 24 are powered by an electric wiring fed through a wiring connector (not shown) and controlled by thermocouple 28.

The thermally reacted exhaust gases then enter into a primary cooling/scrubbing section 30 which is equipped with a conduit cleaning apparatus 34 and a cleaning water supply line 36. Cooling water (not shown) is sprayed through a plurality of nozzles 38 to cool off the high temperature thermally reacted exhaust gases. The temperature of the thermally reacted exhaust gases can reach above 800° C. and therefore must be cooled before it is processed by the secondary cooling/scrubbing section 14. The cleaning apparatus 34 is constructed of a gear 42 that has two cleaning blades 46 installed thereon for scrapping an interior wall 26 to remove unwanted chemical substances deposited thereon. A detailed description of the cleaning apparatus 34 will be given in a later section in reference to FIG. 2.

The function of the cleaning apparatus 34 is to remove the chemical substances (not shown) that have been cumulated and deposited on the interior wall 26 of the exhaust conduit 54 in the thermal reaction section 12. These chemical substances include a variety of high temperature films, nitride powders and films, etc., which normally form a hard and highly resilient substance that is difficult to remove.

Cooled exhaust gases enter into the secondary cooling/scrubbing section 14 and are treated by the scrub packing 48 before it is released to the atmosphere through an outlet 52. The apparatus 10 is effective for treating exhaust gases from a semiconductor fabrication machine that contains toxic elements by first treating in a high temperature oxygenation reaction, converting to a lower temperature, and then converting toxic substances into non-toxic substances such that they can be safely released into the atmosphere.

In the exhaust gas reactor shown in FIG. 1, it has been found that while the apparatus generally achieves the desirable results of toxic gas conversions, a deposition of hard chemical substances on the interior wall 26 in the thermal reaction section 12 can not be avoided. A conventional conduit cleaning apparatus 34 which is equipped with scrapping blades 46 and water spray nozzles 38 is not effective in cleaning the exhaust conduit 54. A detailed perspective view of the components in the cleaning apparatus 34 is shown in FIG. 2.

FIG. 2 is a perspective view of the components of the cleaning apparatus 34. The components include an upper support bracket 56, a pair of cleaning blades 58, a flange plate 60, a Teflon bearing 62, a gear wheel 64, a flange housing 66, a solenoid operated drive 68 which has a push rod 70 installed thereon, a lower Teflon bearing 62 and a lower flange plate 72. The key mechanism of the cleaning apparatus 34 is the cleaning blades 58, the gear wheel 64 and the solenoid driven cylinder 68 together with the push rod 70. In operation, unidirectional gear teeth 74 located on the face of the gear wheel 64 are pushed by the push rod 70 each time the solenoid driven cylinder 68 is activated. The cleaning blades 58 are each equipped with a single knife edge (not shown) such that they perform an unidirectional cleaning operation of the interior wall 26 (FIG. 1) of the thermal reaction section 12. Each time the tip 76 of the push rod 70 advances the gear wheel 64 by 1/16 of the circumference of the interior wall 26. In general, it takes about 160 seconds for the cleaning blades to make a complete sweep of the circumferential surface of the interior wall 26.

Numerous problems have been observed in utilizing the conduit cleaning apparatus 34 during an exhaust gas treatment process. For instance, the displacement of the cleaning blades 58 is limited such that they do not clean the interior wall efficiently. Secondly, since there are only two blades and only one knife edge available for unidirectional cleaning, the cleaning efficiency of the two blades is limited. Thirdly, the high load on the cleaning blades frequently causes the blade to deform and thus stops its cleaning function. Fourthly, the mounting screws of the cleaning blades to the gear wheel 64 frequently break or otherwise deform to disable the blades. Various other problems may also be caused by a disfunctioning of the push rod mounted on the solenoid driven cylinder 68. For instance, the tip 76 of the push rod may break or deform such that the gear teeth 74 on the gear wheel 64 are not touched and as a result, the advancement of the cleaning blades 58 completely stops. Furthermore, the push rod 70 frequently jam between the flange housing and the gear wheel 64 to cause the cleaning apparatus to stop functioning.

In a copending application, Ser. No. 09/141,065, filed Aug. 27, 1998, assigned to the common assignee of the present invention and incorporated here by reference in its entirety, an apparatus for cleaning a conduit and a method for using the apparatus are disclosed.

It is therefore an object of the present invention to provide an apparatus for cleaning a conduit that has unwanted substances coated on an interior wall that does not have the drawbacks and shortcomings of a conventional cleaning apparatus.

It is another object of the present invention to provide an apparatus for cleaning a conduit that has unwanted substances deposited on an interior wall by utilizing a rack-and-pinion drive mechanism for driving at least three cleaning blades.

It is a further object of the present invention to provide an apparatus for cleaning a conduit that has unwanted substances deposited on an interior wall by utilizing cleaning blades that are equipped with two oppositely facing knife blades such that the blades may clean in both a clockwise and a counterclockwise directions.

It is another further object of the present invention to provide an apparatus for cleaning a cavity in an exhaust gas reactor by utilizing a pinion gear equipped with at least three cleaning blades installed thereon and driven by a rack such that a linear motion of the rack is transformed into a rotational motion of the pinion gear allowing the cleaning blades to scrape the interior wall of the cavity.

It is still another object of the present invention to provide an apparatus for cleaning a cavity in an exhaust gas reactor by utilizing three upper cleaning blades and three lower cleaning blades which are securely mounted inside bores in a pinion gear that is at least 3 cm thick such that not only the cavity in the exhaust gas reactor but also a chamber below such cavity of the reactor can be cleaned.

It is yet another object of the present invention to provide an apparatus for cleaning a cavity in an exhaust gas reactor wherein at least three cleaning blades are mounted on a pinion gear such that knife edges on the cleaning blades are situated in a circumference that is not more than 10 mm smaller than a circumference of an interior wall of the cavity.

It is still another further object of the present invention to provide a method for cleaning a conduit that has unwanted substances coated on an interior wall of the conduit by utilizing a cleaning apparatus that comprises a tall pinion gear and at least three cleaning blades installed therein for scrapping the interior wall of the conduit.

It is yet another further object of the present invention to provide a method for cleaning a conduit that has unwanted substances coated on an interior wall of the conduit by first providing a cleaning apparatus that includes a tall pinion gear with at least three cleaning blades securely mounted therein each having two oppositely facing knife blades such that the cleaning blades cleans in both directions when the pinion gear turns in a clockwise or in a counterclockwise direction.

SUMMARY OF THE INVENTION

In accordance with the present invention, an apparatus for cleaning a conduit that has unwanted substances coated on an interior wall and a method for utilizing such apparatus are provided.

In a preferred embodiment, an apparatus for cleaning a conduit that has unwanted substances deposited on an inner wall is provided which includes a tall pinion gear that has at least three spokes radiating inwardly from an inner rim of the pinion gear toward a center each having a bore adapted for mounting therein the lower ends of at least three blades equally spaced from each other circumferentially, an upper retaining bracket of circular shape adapted for mounting thereto the upper ends of the at least three blades equally spaced from each other circumferentially, the at least three blades when mounted in the pinion gear and in the upper retaining bracket each has two oppositely facing knife edges such that at least six knife edges are situated in a circumference that is not more than 10 mm smaller than the circumference of an inner wall of the conduit to be cleaned, and a rack for intimately engaging the pinion gear adapted for transforming a linear motion of the rack to a rotational motion of the pinion gear in both clockwise and counterclockwise directions to enable the at least six knife edges to scrape off unwanted substances from the inner wall of the conduit.

The apparatus may further include at least three lower blades that has upper ends mounted to the at least three spokes in the pinion gear and lower ends mounted to a lower retaining bracket, the at least three lower blades are situated equally spaced from each other circumferentially and are adapted for cleaning a second conduit situated below the conduit. The apparatus may further include a circular-shaped housing for intimately mounting the pinion gear and the rack therein. The apparatus may further include an electrically operated drive means for reciprocally driving the rack in linear motion. The apparatus may further include means for manually driving the rack. The apparatus may be adapted for cleaning the interior wall of a thermal reactor in an exhaust gas conditioning equipment.

In another preferred embodiment, an apparatus for cleaning a cavity in an exhaust gas reactor is provided which includes a pinion gear that has three spokes of at least 3 cm thick each extending inwardly from an inner rim of the pinion gear toward the center adapted for mounting the lower ends of three blades equally spaced from each other circumferentially, an upper retaining bracket of circular shape adapted for mounting thereto upper ends of the three blades equally spaced from each other circumferentially, the three blades when mounted in the pinion gear and the upper retaining bracket each has two oppositely facing knife edges such that six knife edges are situated in a circumference that is not more than 10 mm smaller than a circumference of an inner wall of the cavity to be cleaned, and a rack for engaging the pinion gear adapted for transforming a linear motion of the rack to a rotational motion of the pinion gear in both clockwise and counterclockwise directions to enable the six knife edges to scrape off unwanted chemical substances from the inner wall of the cavity.

The six knife edges are situated in a circumference that is preferably not more than 55 mm smaller than the circumference of an inner wall of the cavity to be cleaned. The apparatus may further include three lower blades that have upper ends mounted to the three spokes in the pinion gear and lower ends mounted to a lower retaining bracket. The three lower blades may be situated equally spaced from each other circumferentially and are adapted for cleaning a second cavity situated below the cavity. The apparatus may further include a circular-shaped housing for mounting the pinion gear and the rack therein for achieving an intimate engagement between the pinion gear and the rack. The apparatus may further include an electrical drive means for reciprocally driving the rack in linear motion. The exhaust gas reactor can be a thermal reactor utilized in an exhaust gas conditioning equipment. The apparatus may further include means for manually driving the rack.

The present invention is further directed to a method for cleaning a conduit that has unwanted chemical substances coated on an inner wall by the operating steps of first providing a cleaning apparatus that has a pinion gear having at least three blades mounted thereon at a lower end, the lower ends of the at least three blades are mounted to an upper retaining bracket, the at least two blades each has two oppositely facing knife edges for frictionally engaging the unwanted chemical substances coated on the inner wall of the conduit, and a rack for intimately engaging the pinion gear, then positioning the at least three blades into the conduit, and reciprocally moving the rack and transforming a linear motion of the rack to a rotational motion of the pinion gear in both clockwise and counterclockwise directions to enable the at least six knife edges to scrape off unwanted chemical substances from the inner wall of the conduit.

The method may further include the step of providing at least three lower blades each has an upper end mounted to the tall pinion gear and lower end to a lower retaining bracket, and rotating the at least three lower blades for cleaning the interior wall of a second conduit situated below the conduit. The method may further include the step of providing a circular-shaped housing and mounting the pinion gear and the rack therein to achieve an intimate engagement. The method may further include the step of providing an electrical drive means for reciprocally driving the rack in linear motion. The method may still further be adapted for cleaning the interior wall of a thermal reactor in an exhaust gas conditioning equipment.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

In accordance with the present invention, an apparatus and a method for cleaning a conduit that has unwanted substances coated on an inner wall are provided. The cleaning apparatus is operated by a rack-and-pinion drive system of a set of cleaning blades mounted in a tall pinion gear. A solenoid type drive cylinder is used to provide a linear motion of a rack which is transformed to a rotational motion of a pinion gear when the rack intimately engages the pinion gear. A cleaning blade system of at least two blades, and preferably at least three blades are utilized in the present invention novel apparatus. The cleaning blades are each equipped with two oppositely facing knife edges such that the blades are capable of cleaning when the pinion gear is turned either in a clockwise direction or in a counterclockwise direction. The advantages provided by the double-faced cleaning blades and the precision drive of a rack-and-pinion system provides a cleaning method that is far superior than those achievable by conventional cleaning apparatus. The chances of malfunction of the apparatus are greatly reduced which result in an improvement in the cleaning efficiency and wafer yield. The present invention apparatus and method therefore provide a greatly improved result in cleaning a conduit or a cavity that has unwanted substances deposited therein than those possible with conventional methods.

Figure 1:
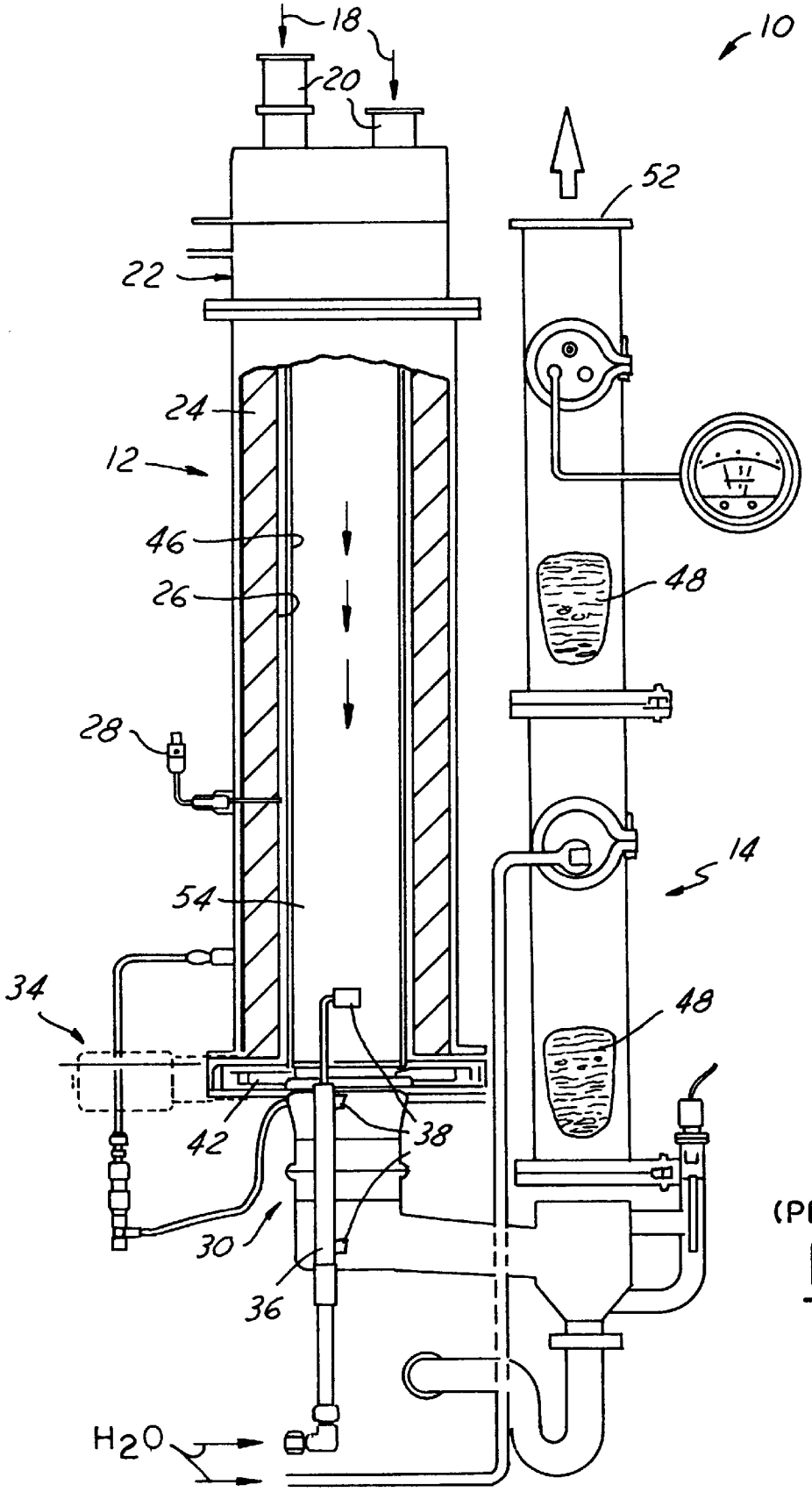
(PRIOR ART) FIG. 1
FIG. 1 is a cross-sectional view of a conventional exhaust gas treatment system including a thermal reaction section.
Figure 2:
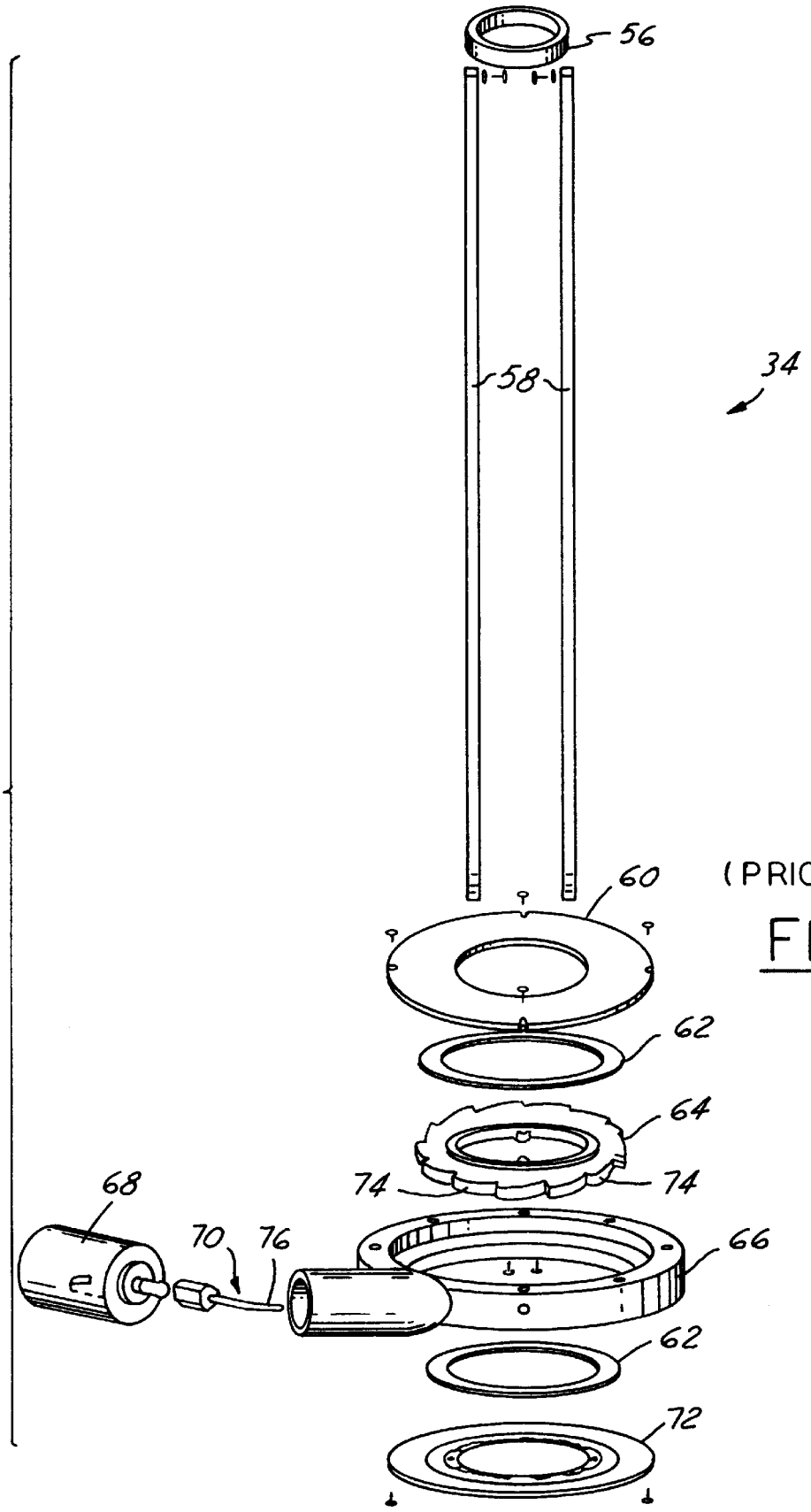
(PRIOR ART) FIG. 2
FIG. 2 is an enlarged, perspective view of the components of the conventional cleaning apparatus utilized in the thermal reaction section shown in FIG. 1.
Figure 3:
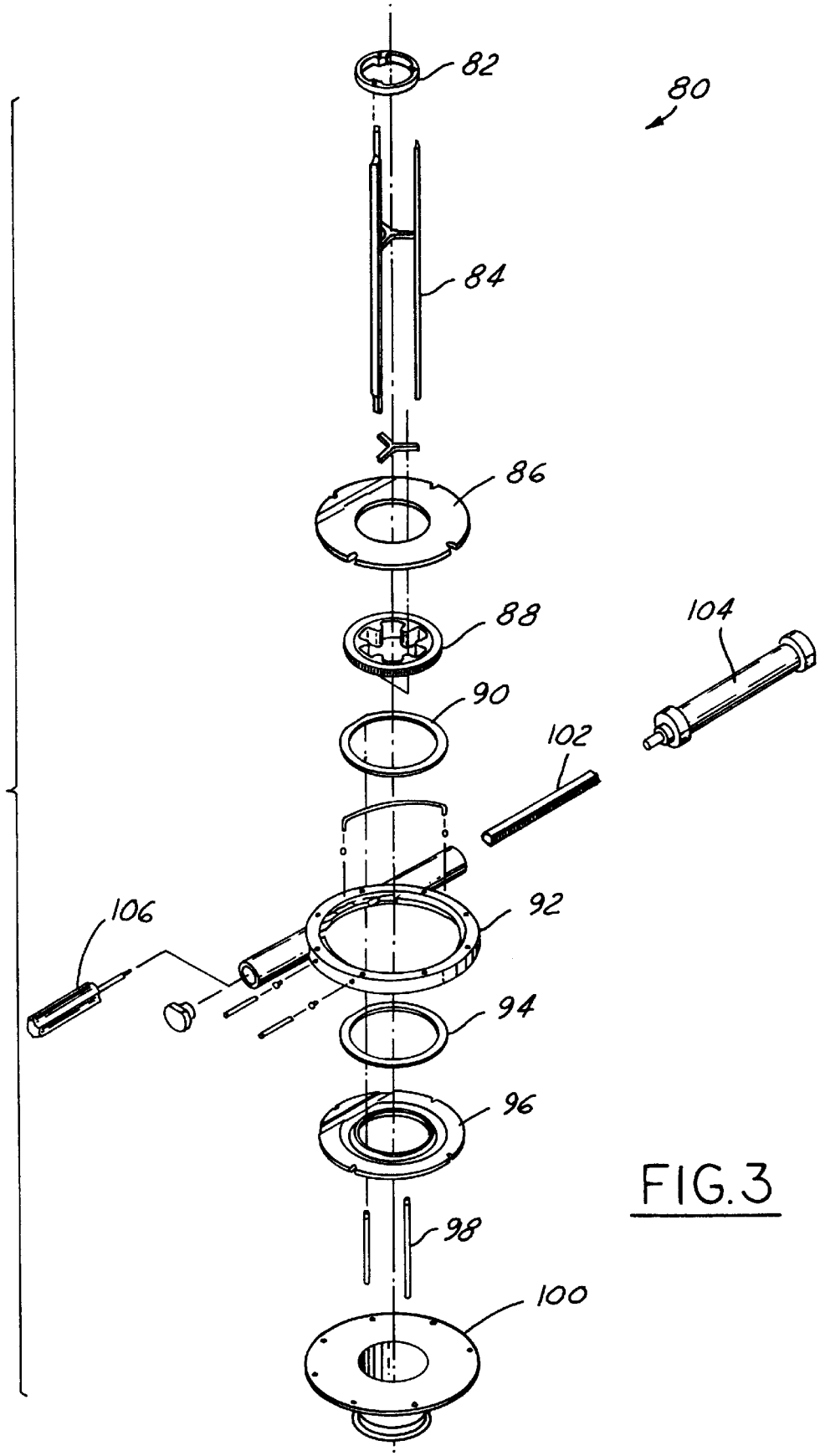
FIG. 3 is a perspective view of the present invention conduit cleaning apparatus utilizing a rack-and-pinion driven cleaning blade system wherein the pinion gear is at least 3 cm thick.
Figure 4:
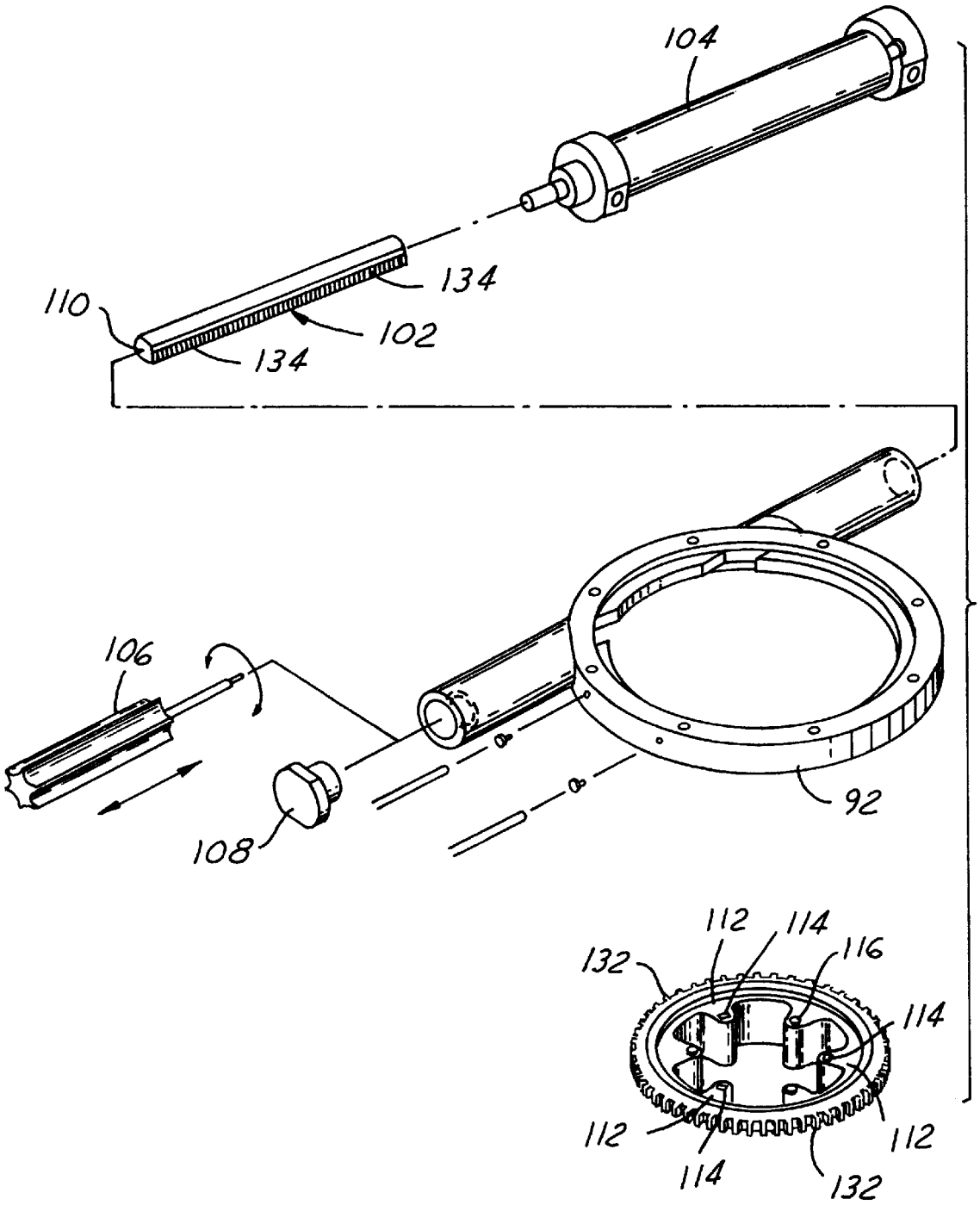
FIG. 4 is an enlarged, cross-sectional view of the rack-and-pinion system used in the present invention cleaning apparatus of FIG. 3.

Referring now to FIG. 3, wherein a present invention cleaning apparatus 80 is shown. The cleaning apparatus 80 consists mainly of an upper retaining bracket 82, a set of cleaning blades 84, an upper flange plate 86, a pinion gear 88, an upper Teflon bearing 90, a flange housing 0 92, a lower Teflon bearing 94, a lower flange plate 96, a set of lower cleaning blades 98 and a lower retaining bracket 100. Assembled into the flange housing 92 are a rack 102, a solenoid-type drive cylinder 104 and a manually operated handle 106. A perspective view of the drive mechanism for the present invention novel cleaning apparatus 80 is shown in FIG. 4. For instance, shown in enlarged views are the flange housing 92, the end cap 108, the pinion gear 88, the rack 102 and the solenoid-type drive cylinder 104. A manually operated handle 106 for the rack 102 is also shown. When attached to a threaded aperture 110 at the tip of the rack 102, the handle 106 may be used to manually displace the rack in a linear motion, for instance, during a preventive maintenance procedure. As shown in FIG. 4, the pinion gear 88 is equipped with three spokes 112 each having an aperture 114 for mounting the set of cleaning blades 84 therein. Mounting holes 116 provided in bosses 116 are utilized for mounting of the lower blades 98.

Figure 5A:
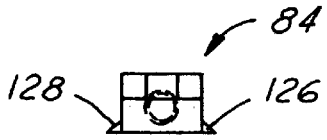
FIGS. 5A, 5B and 5C are end view, plane view and side view, respectively, of the cleaning blades utilized in the present invention cleaning apparatus of FIG. 3.
Figure 5B:
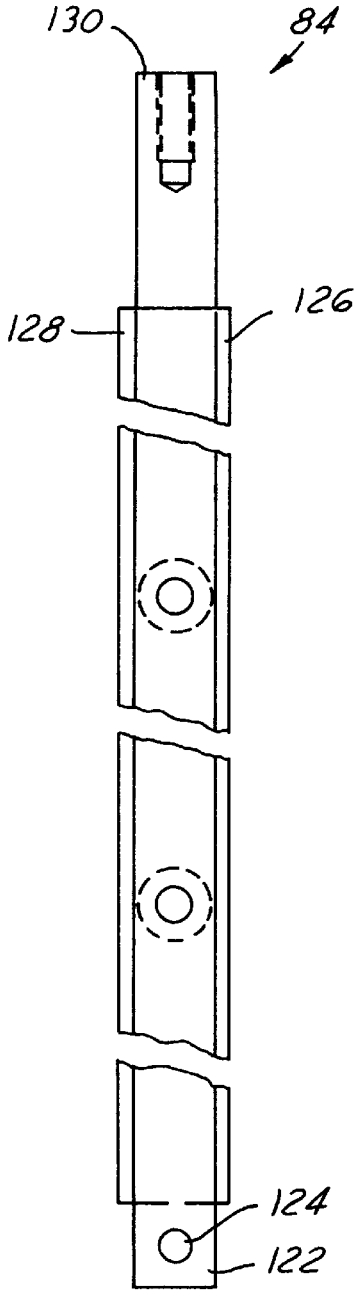
Figure 5C:
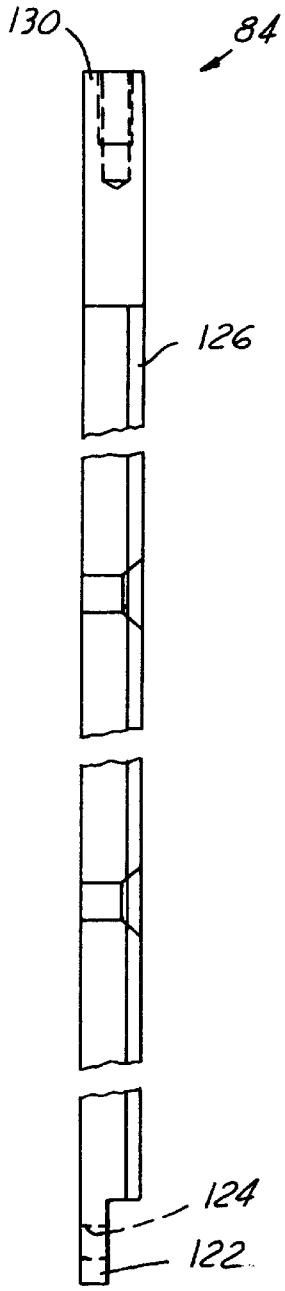

An end view, plane view and side view of the cleaning blades 84 are shown in FIGS. 5A, 5B and 5C, respectively. It is seen that an upper retaining bracket 82 (FIG. 7A) is equipped with bosses 140 for mounting thereto the upper tip 122 of the blades 84. Mounting holes 124 are provided in the tip 122 for mounting the blades by screws (not shown) to the upper retaining bracket 82. It should be noted that each of the cleaning blades 84, is provided with two oppositely facing knife edges 126 and 128 such that the blades 84 may cut into the unwanted substances when the blades are turned either in a clockwise direction or in a counterclockwise direction. This is one of the benefits made possible by the present invention novel apparatus.

Another benefit made possible by the present invention novel apparatus is the rack-and-pinion drive mechanism shown in FIG. 4. The rack 102 and the pinion gear 88 are intimately matched together such that several teeth 132 on the pinion gear 88 engage a small section of the teeth 134 on the rack 102 simultaneously. This drive mechanism is significantly improved when compared to that utilized in the conventional apparatus wherein only one tooth is engaged by a push rod at a time. A more reliable drive is therefore achieved by the present invention apparatus. Furthermore, instead of pushing a gear wheel only in one direction in the conventional drive mechanism, the reciprocal movement of the present invention rack 102 results in a rotational motion of the pinion gear 88 in two directions, i.e., clockwise and counterclockwise. Combined with the double-edged blades 84, the efficiency of scraping off unwanted substances from the interior wall of a reactor is greatly improved since the substances can be removed by the double-edged blades when the rack is either pushed or pulled. The present invention rack-and-pinion drive mechanism therefore provides a greatly improved and unexpected result over that achievable by the conventional apparatus.

The present invention further provides a greatly improved pinion gear 88, as shown in FIG. 4, which has a large thickness such that the lower end 130 can be securely mounted inside the aperture 114 provided in the spokes 112. The thickness of the spokes section is at least 3 cm, and preferably at least 4 cm. A plane view and a cross-sectional view of the pinion gear 88 are shown in FIGS. 6A and 6B, respectively.

Figure 6A:
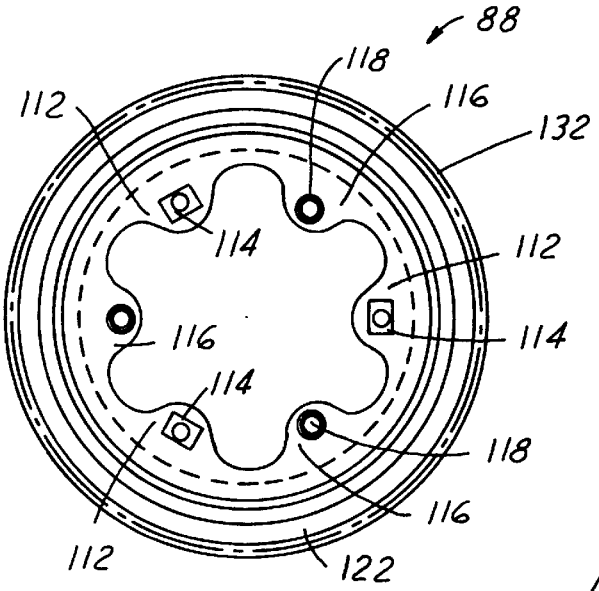
FIGS. 6A and 6B are plane view and cross-sectional view of a tall pinion gear utilized in the present invention cleaning apparatus of FIG. 3.
Figure 6B:
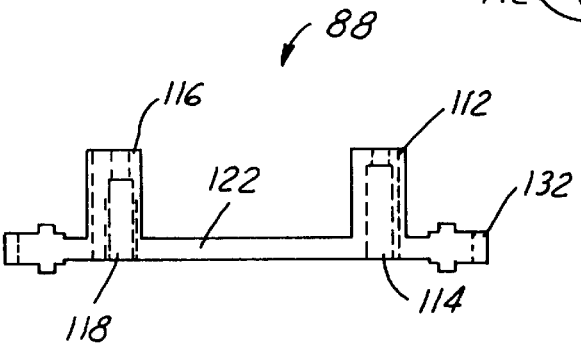

As shown in FIGS. 6A and 6B, the thickened section of the pinion gear 88 further includes boss sections 116 which are provided with apertures 118 therein. The apertures 118 are used to mount the three lower blades 98 shown in FIG. 3 adapted for cleaning a lower conduit (not shown).

Figure 7A:
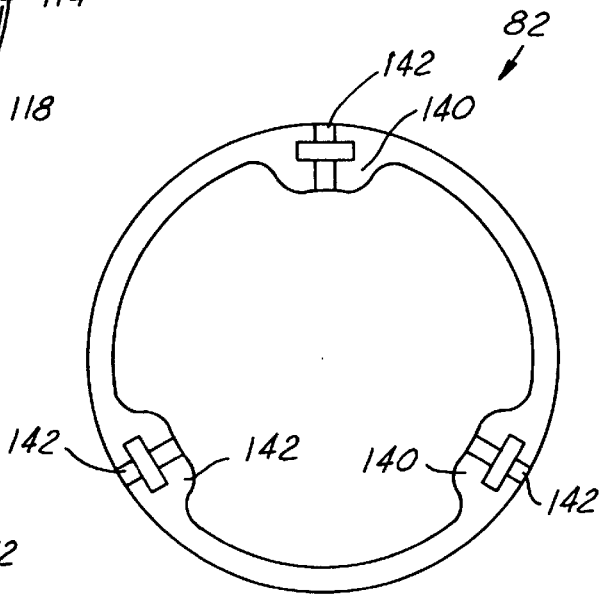
FIGS. 7A and 7B are plane view and cross-sectional view of an upper retaining bracket utilized in the present invention cleaning apparatus of FIG. 3.
Figure 7B:
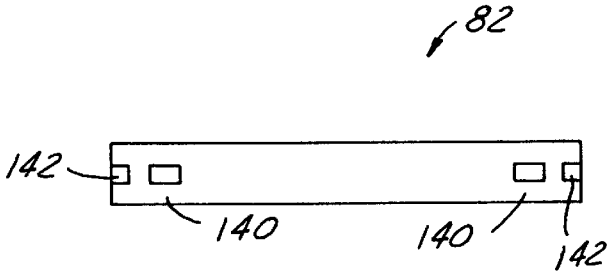

Similarly, FIGS. 7A and 7B show a plane view and a cross-sectional view of an upper retaining bracket 82 (also shown in FIG. 3). The upper retaining bracket 82 is constructed with three thickened boss sections 140 each provided with a bolt hole 142 for mounting of the upper ends 122 of the three blades 84.

The present invention novel apparatus and method have therefore been amply demonstrated in the above descriptions and in the appended drawings of FIGS. 3–7. It should be noted that while the present invention apparatus is illustrated in the environment of a thermal reaction chamber for an exhaust gas conditioning equipment, the apparatus may be similarly used in any equipment for the cleaning of a conduit as long as there is unwanted chemical substances cumulated on an interior wall of the conduit.

While the present invention has been described in an illustrative manner, it should be understood that the terminology used is intended to be in a nature of words of description rather than of limitation.

Furthermore, while the present invention has been described in terms of a preferred embodiment and an alternate embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for cleaning an inner wall of a conduit having unwanted substances deposited thereon comprising:

a pinion gear having at least three spokes radiating inwardly from an inner rim of said pinion gear toward a center and said spokes having a thickness of at least 3 cm adapted for mounting thereto the lower ends of at least three blades equally spaced from each other circumferentially, an upper retaining bracket of circular shape adapted for mounting thereto the upper ends of said at least three blades equally spaced from each other circumferentially, said at least three blades when mounted in said pinion gear and said upper retaining bracket each having two oppositely facing knife edges such that at least six knife edges are situated in a circumference that is not more than 10 mm smaller than the circumference of an inner wall of said conduit to be cleaned, and a rack for intimately engaging said pinion gear adapted for transforming a linear motion of the rack to a rotational motion of the pinion gear in both clockwise and counterclockwise directions to enable said at least six knife edges to scrape off unwanted chemical substances from said inner wall of said conduit.

2. An apparatus for cleaning an inner wall of a conduit having unwanted substances deposited thereon according to claim 1 further comprising at least three lower blades having upper ends mounted to said at least three spokes in the pinion gear and lower ends mounted to a lower mounting ring, said at least three lower blades are situated equally spaced from each other circumferentially and are adapted for cleaning a second conduit situated below said conduit.

3. An apparatus for cleaning an inner wall of a conduit having unwanted substances deposited thereon according to claim 1, wherein said at least three spokes having a thickness of at least 4 cm.

4. An apparatus for cleaning an inner wall of a conduit having unwanted substances deposited thereon according to claim 1 further comprising a circular-shaped housing for mounting intimately said pinion gear and said rack therein.

5. An apparatus for cleaning an inner wall of a conduit having unwanted substances deposited thereon according to claim 1 further comprising an electrically operated drive means for reciprocally driving said rack in linear motion.

6. An apparatus for cleaning an inner wall of a conduit having unwanted substances deposited thereon according to claim 1 further comprising means for manually driving said rack.

7. An apparatus for cleaning an inner wall of a conduit having unwanted substances deposited thereon according to claim 1, wherein said apparatus is adapted for cleaning the interior wall of a thermal reactor in an exhaust gas conditioning equipment.

8. An apparatus for cleaning a cavity in an exhaust gas reactor comprising:

a pinion gear having three spokes extending inwardly from an inner rim of said pinion gear toward the center adapted for mounting therein lower ends of three blades equally spaced from each other circumferentially, said three spokes each having a bore and a thickness sufficiently large for said lower ends of said three blades mounted securely therein, an upper retaining bracket of circular shape adapted for mounting thereto upper ends of said three blades equally spaced from each other circumferentially, said three blades when mounted in said pinion gear and said upper retaining bracket each having two oppositely facing knife edges such that six knife edges are situated in a circumference that is not more than 10 mm smaller than the circumference of an inner wall of the cavity to be cleaned, and a rack for engaging said pinion gear adapted for transforming a linear motion of the rack to a rotational motion of the pinion gear in both clockwise and counterclockwise directions to enable said six knife edges to scrape off unwanted substances from said inner wall of said cavity.

9. An apparatus for cleaning a cavity in an exhaust gas reactor according to claim 8, wherein said six knife edges are situated in a circumference that is preferably not more than 5 mm smaller than the circumference of an inner wall of said cavity to be cleaned.

10. An apparatus for cleaning a cavity in an exhaust gas reactor according to claim 8 further comprising three lower blades having upper ends mounted to three bosses in the pinion gear and lower ends mounted to a lower retaining bracket, said three lower blades are situated equally spaced from each other circumferentially and are adapted for cleaning a second cavity situated below said cavity.

11. An apparatus for cleaning a cavity in an exhaust gas reactor according to claim 8 further comprising a circular-shaped housing for mounting said pinion gear and said rack therein for achieving an intimate engagement between the pinion gear and the rack.

12. An apparatus for cleaning a cavity in an exhaust gas reactor according to claim 8 further comprising an electrical drive means for reciprocally driving said rack in linear motion.

13. An apparatus for cleaning a cavity in an exhaust gas reactor according to claim 8, wherein said thickness for said three spokes that is sufficiently large is at least 3 cm.

14. An apparatus for cleaning a cavity in an exhaust gas reactor according to claim 8, wherein said thickness for said three spokes that is sufficiently large is at least 4 cm.

* * * * *